US009838765B1

(12) United States Patent
Li et al.

(10) Patent No.: US 9,838,765 B1
(45) Date of Patent: Dec. 5, 2017

(54) SPEAKER BOX

(71) Applicants: Shuai Li, Shenzhen (CN); Fan Zhang, Shenzhen (CN)

(72) Inventors: Shuai Li, Shenzhen (CN); Fan Zhang, Shenzhen (CN)

(73) Assignee: AAC TECHNOLOGIES PTE. LTD., Singapore (SG)

( * ) Notice: Subject to any disclaimer, the term of this patent is extended or adjusted under 35 U.S.C. 154(b) by 0 days.

(21) Appl. No.: 15/417,039

(22) Filed: Jan. 26, 2017

(30) Foreign Application Priority Data

Oct. 26, 2016 (CN) ..... 2016 2 1173796 U

(51) Int. Cl.
*H04R 1/02* (2006.01)
*H04R 1/28* (2006.01)

(52) U.S. Cl.
CPC ..... *H04R 1/025* (2013.01); *H04R 1/023* (2013.01); *H04R 1/288* (2013.01)

(58) Field of Classification Search
CPC ..... H04R 1/02
See application file for complete search history.

(56) References Cited

U.S. PATENT DOCUMENTS

2017/0164096 A1* 6/2017 Herold ..... H04R 1/2853

* cited by examiner

*Primary Examiner* — Olisa Anwah
(74) *Attorney, Agent, or Firm* — Na Xu; IPro, PLLC

(57) ABSTRACT

A speaker box includes a housing with an accommodation space including a retaining wall for dividing the accommodation space into a front cavity and a rear cavity opposite to the front cavity; a speaker unit received in the front cavity of the accommodation space; sound-absorbing powder arranged in rear cavity of the housing; and a separation mesh injection-molded with the retaining wall. The retaining wall includes a through hole for communicating the front cavity with the rear cavity, the separation mesh covers the through hole for separating the sound-absorbing powder from the front cavity.

8 Claims, 4 Drawing Sheets

SPEAKER BOX

FIELD OF THE PRESENT DISCLOSURE

The present disclosure relates to the field of electro-acoustic transducers, and more particularly to a speaker box used in a portable electronic device.

DESCRIPTION OF RELATED ART

The speaker box of related technology is to achieve the better acoustic performance, so that sound-absorbing powder is often filled in the internal cavity of the speaker box. In the conventional method, the sound-absorbing powder is sealed in a separate case, and then, the case in which the sound-absorbing powder is sealed is fitted into the internal cavity of the speaker box. Designed in such a manner, it is difficult to get full use of the internal cavity space of the speaker box and it is limited to improve the acoustic performance.

Thereof, it is necessary to disclose and provide an improved speaker box to overcome the above-mentioned disadvantages.

BRIEF DESCRIPTION OF THE DRAWING

Many aspects of the exemplary embodiment can be better understood with reference to the following drawing. The components in the drawing are not necessarily drawn to scale, the emphasis instead being placed upon clearly illustrating the principles of the present disclosure.

DETAILED DESCRIPTION OF THE EXEMPLARY EMBODIMENT

The present disclosure will hereinafter be described in detail with reference to an exemplary embodiment. To make the technical problems to be solved, technical solutions and beneficial effects of the present disclosure more apparent, the present disclosure is described in further detail together with the figure and the embodiment. It should be understood the specific embodiment described hereby is only to explain this disclosure, not intended to limit this disclosure.

Figure 1:
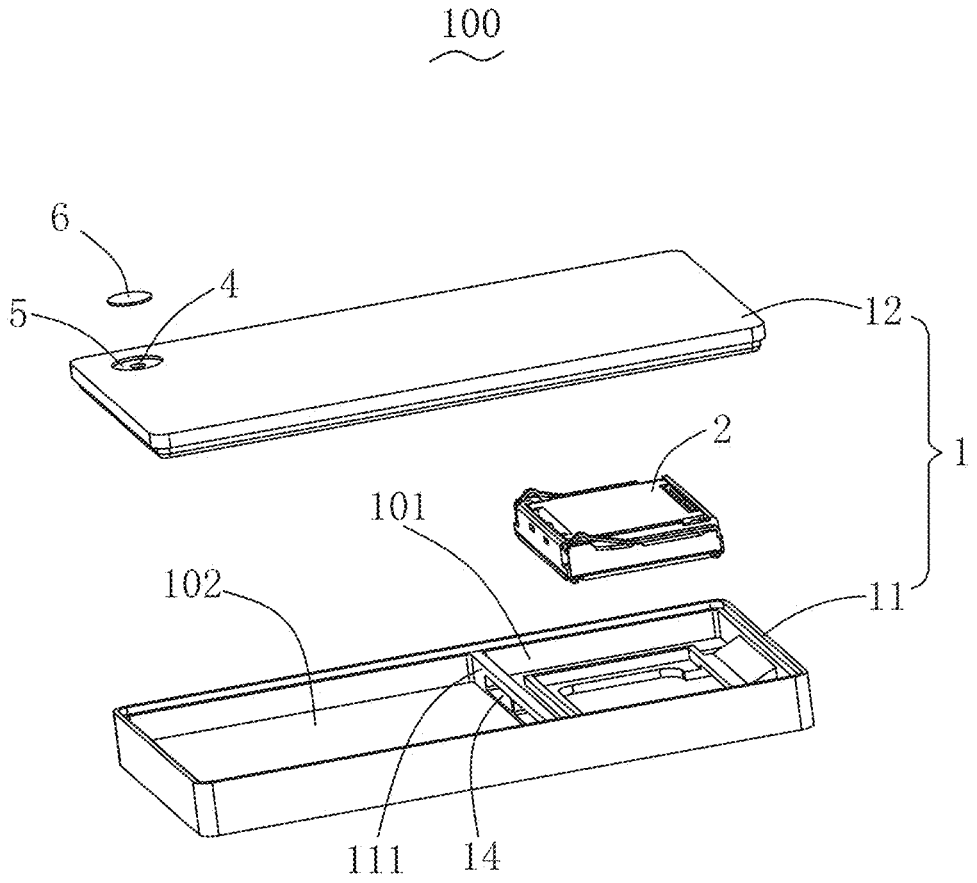
FIG. 1 is an isometric and exploded view of a speaker box in accordance with an exemplary embodiment of the present disclosure.
Figure 2:
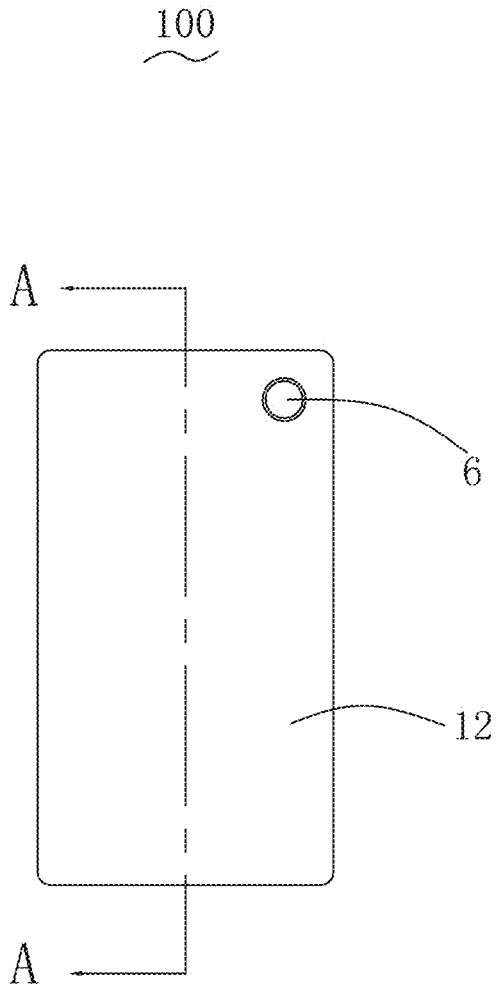
FIG. 2 is a front view of the speaker box in FIG. 1.
Figure 3:
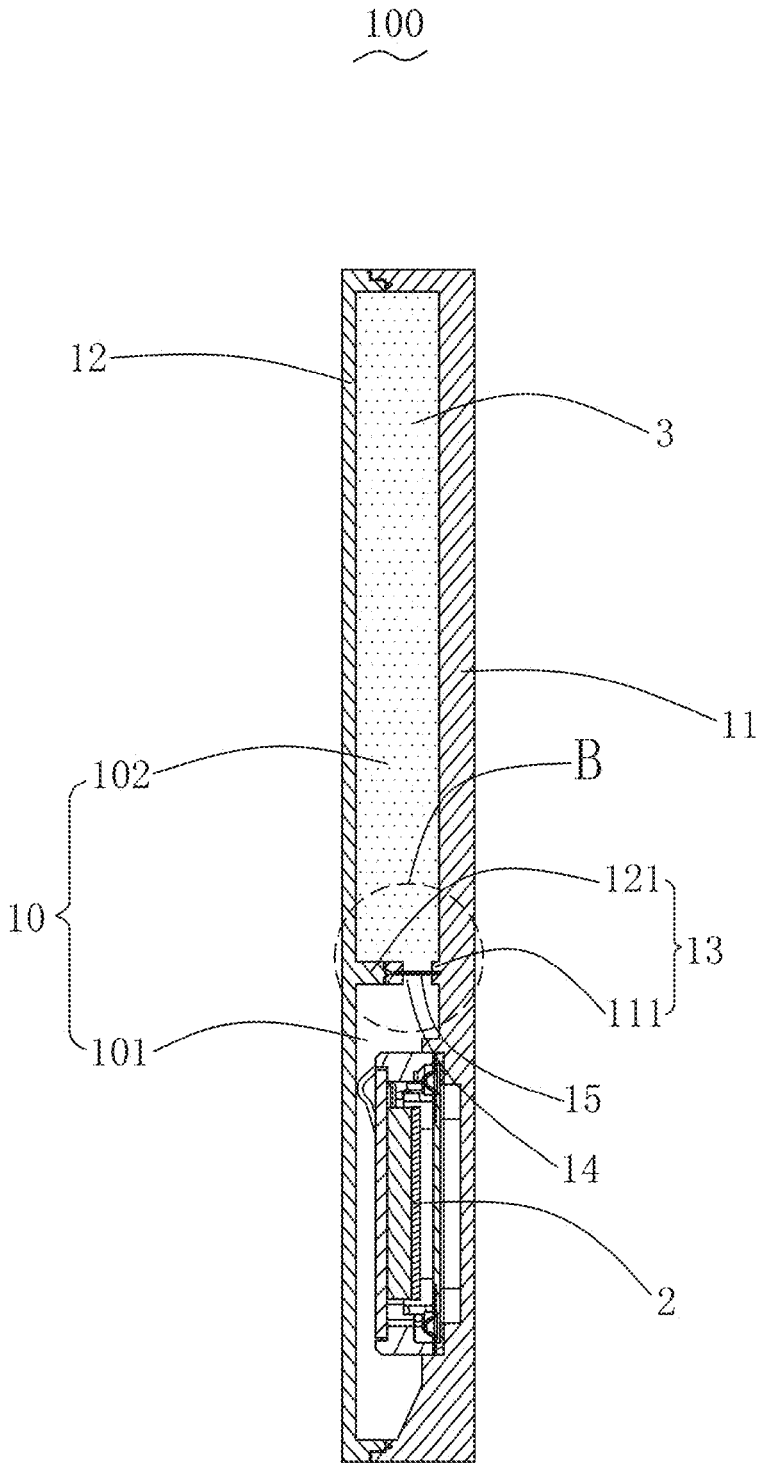
FIG. 3 is a cross-sectional view of the speaker box taken along line A-A in FIG. 2.
Figure 4:
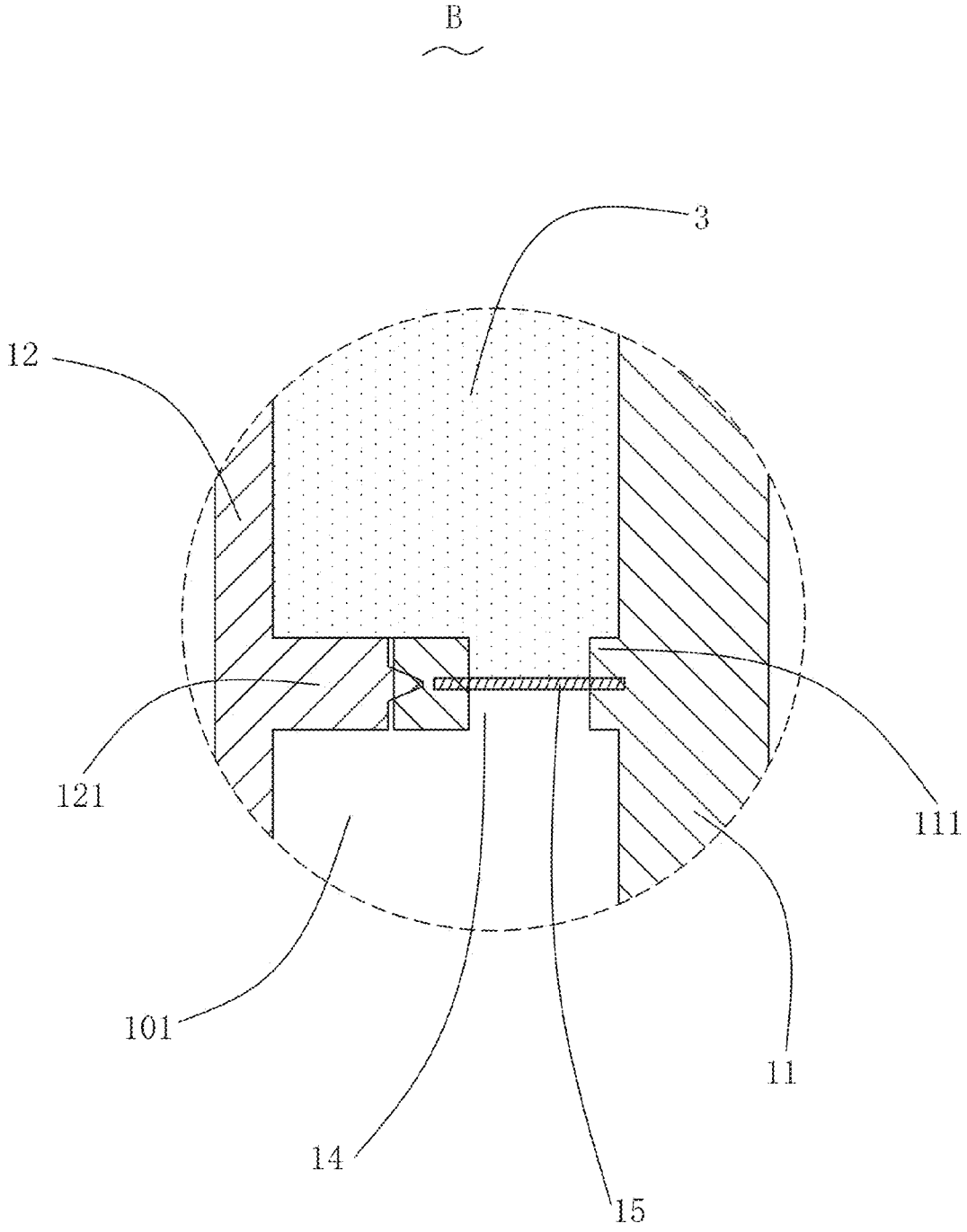
FIG. 4 is an enlarged view of Part B in FIG. 3.

As shown in FIGS. 1-4, a speaker box 100 in accordance with an exemplary embodiment of the present disclosure includes a housing 1 with an accommodation space 10, a speaker unit 2 and sound-absorbing powder 3 received in the housing 1. The housing 1 includes a retaining wall 13 for separating the accommodation space 10 into a front cavity 101 and a rear cavity 102 opposed to the front cavity 101. The speaker unit 2 is accommodated in the front cavity 101. The sound absorption powder 3 is provided in the rear cavity 102. The retaining wall 13 is provided with a through hole 14 to communicate with the front cavity 101 and the rear cavity 102, and in the retaining wall 13 a separation mesh 15 is insert-molded for covering the through hole 14. The separation mesh 15 separates the sound absorption powder 3 from entering the front cavity 101. The separation mesh 15 is one of a nonwoven fabric, a woven fabric, a dustproof mesh, a nylon braid, and a metal mesh.

The housing 1 includes an injection hole 4 in accordance with the position of the rear cavity 102. The sound absorptive powder 3 is filled into the rear cavity 102 via the injection hole 4. A sealing net 6 is disposed at the injection hole 4 for covering the injection hole 4 and sealing the sound-absorbing powder 3 in the rear cavity 102. The housing 1 is provided with a groove 5 at the injection hole 4, and the sealing net 6 is provided in the groove 5. Optionally, the sealing net 6 is an air-permeable structure, and the injection hole 4 can serve as a leak hole of the rear cavity 102.

In the present embodiment, the housing 1 includes a first housing 11 and a second housing 12 engaging with the first housing 11. The first housing 11 and the second housing 12 are ultrasonically welded for forming an integrated one. The retaining wall 13 includes a first retaining wall 111 provided in the first housing 11, and a second retaining wall 121 provided in the second housing 12. The first retaining wall 111 and the second retaining wall 121 are ultrasonically welded to form the retaining wall 13. The through-hole 14 is provided in the first retaining wall 111, and the separation mesh 15 is molded in the first retaining wall 111, the first housing 11, the first retaining wall 111, and the separation mesh 15 are integrated injection. The through hole 14 may be provided in the second retaining wall 121, too. In this case, the separation mesh 15 is molded on the second retaining wall 121. Similarly, the second housing 12, the second retaining wall 121 and the separation mesh 15 may be integrally injection-molded. Further, the injection hole 4 may be provided in the first housing 11 in addition to the case of the second housing 12 as in the present embodiment.

The present disclosure provides the speaker box with the retaining wall in the housing, the retaining wall divides the housing into the front cavity and the rear cavity opposite to the front cavity. The speaker unit is disposed in the front cavity, the sound-absorbing powder is disposed in the rear cavity. The retaining wall is provided with the through hole to connect the front cavity and the rear cavity, and the retaining wall is injection-molded with the separation mesh. The separation mesh covers the through hole, and separates the sound-absorbing powder from the front cavity, which can fully utilize the housing space to fill the sound absorption powder, and the speaker box has good acoustic performance.

It is to be understood, however, that even though numerous characteristics and advantages of the present exemplary embodiment have been set forth in the foregoing description, together with details of the structures and functions of the embodiment, the disclosure is illustrative only, and changes may be made in detail, especially in matters of shape, size, and arrangement of parts within the principles of the invention to the full extent indicated by the broad general meaning of the terms where the appended claims are expressed.

What is claimed is:

1. A speaker box comprising:

a housing with an accommodation space including a retaining wall for dividing the accommodation space into a front cavity and a rear cavity opposite to the front cavity;

a speaker unit received in the front cavity of the accommodation space;

sound-absorbing powder arranged in rear cavity of the housing;

a separation mesh injection-molded with the retaining wall;

wherein the retaining wall includes a through hole for communicating the front cavity with the rear cavity, the separation mesh covers the through hole for separating the sound-absorbing powder from the front cavity, the housing includes an injection hole corresponding to the rear cavity, and the sound-absorbing powder is filled into the rear cavity through the injection hole.

2. The speaker box as described in claim 1, wherein the housing includes a sealing net at the injection hole for covering the injection hole to seal the sound-absorbing powder in the rear cavity.

3. The speaker box as described in claim 2, wherein the housing includes a groove at the injection hole, and the sealing net is provided in the groove.

4. The speaker box as described in claim 1, wherein the housing includes a first housing and a second housing engaging with the first housing, the retaining wall comprises a first retaining wall in the first housing and a second retaining wall in the second housing.

5. The speaker box as described in claim 4, wherein the through hole is formed in the first retaining wall, and the separation mesh is injection-molded with the first retaining wall.

6. The speaker box as described in claim 5, wherein the first housing, the first retaining wall and the separation mesh are integrally injection-molded.

7. The speaker box as described in claim 1, wherein the separation mesh is one of a nonwoven fabric, a dustproof mesh cloth, a nylon braid and a metal mesh.

8. The speaker box as described in claim 2, wherein the sealing net is a breathable structure.

* * * * *